United States Patent [19]

Babendererde et al.

[11] Patent Number: 4,820,458

[45] Date of Patent: Apr. 11, 1989

[54] PROCESS FOR CONTINUOUSLY LINING A TUNNEL WITH EXTRUDED CONCRETE

[75] Inventors: Siegmund Babendererde, Bad Vilbel; Gunnar Lah, Erzhausen; Otto Braach, Hattingen, all of Fed. Rep. of Germany

[73] Assignee: Hochtief Ag Vorm. Gebr. Helfmann, Essen, Fed. Rep. of Germany

[21] Appl. No.: 882,274

[22] Filed: Jul. 7, 1986

[30] Foreign Application Priority Data

Aug. 22, 1985 [DE] Fed. Rep. of Germany ..... 3529998

[51] Int. Cl.[4] ..... B28B 1/14; E21D 11/10

[52] U.S. Cl. ..... 264/34; 264/33; 264/256; 264/269; 264/308; 405/146

[58] Field of Search ..... 425/262, 258, 427; 264/33, 34, 256, 255, 269, 267, 308; 405/146, 147

[56] References Cited

U.S. PATENT DOCUMENTS

| | | | |
|---|---|---|---|
| 1,532,555 | 4/1925 | Rice | 264/33 |
| 2,144,013 | 1/1939 | Donaldson | 264/33 |
| 3,723,041 | 3/1973 | Brown | 425/262 |
| 3,966,389 | 6/1976 | Shubert | 425/262 X |
| 4,150,176 | 4/1979 | Beckers | 264/269 X |
| 4,437,788 | 3/1984 | Walbröhl | 405/146 |
| 4,530,621 | 7/1985 | Furuta et al. | 405/146 X |
| 4,618,298 | 10/1986 | Takamiya et al. | 405/146.4 |
| 4,645,378 | 2/1987 | Hentschel | 405/146 |
| 4,652,174 | 3/1987 | Cornely et al. | 264/33 X |

FOREIGN PATENT DOCUMENTS

| | | | |
|---|---|---|---|
| 2452247 | 5/1975 | Fed. Rep. of Germany . | |
| 3141273 | 5/1983 | Fed. Rep. of Germany . | |
| 3141272 | 5/1983 | Fed. Rep. of Germany . | |
| 3406980 | 4/1985 | Fed. Rep. of Germany . | |
| 45-36186 | 11/1970 | Japan | 137/874 |

*Primary Examiner*—Jan H. Silbaugh
*Assistant Examiner*—Karen D. Kutach
*Attorney, Agent, or Firm*—Herbert Dubno; Andrew Wilford

[57] ABSTRACT

A tunnel having an inner surface and extending along an axis is lined with pumpable concrete having a predetermined hardening time and by a form having an annular inner wall and an axially movable front wall. Substantially equal sized batches of pumpable concrete are successively injected into the space through the movable front wall through a plurality of angularly equispaced ports therein. The batches are injected axially backwardly through the ports at such a rate that succeeding batches are injected through each port at a time interval that is substantially smaller than the concrete hardening time. The front wall is displaced forward at such a rate and the batches are sized such that each batch spreads over a predetermined axial and a predetermined angular distance, such that the latter is greater than the former.

3 Claims, 1 Drawing Sheet

PROCESS FOR CONTINUOUSLY LINING A TUNNEL WITH EXTRUDED CONCRETE

FIELD OF THE INVENTION

Our present invention relates to a method of or a process for continuously lining a tunnel with extruded or pumpable concrete. It also relates to an apparatus for making a concrete tunnel lining according to the process of our invention.

BACKGROUND OF THE INVENTION

A concrete tunnel lining can be formed using a pumping device for feeding extruded or pumpable concrete into a tunnel and a form including an interior form member and a forwardly movable form front having a plurality of concrete input ports distributed uniformly around the annular space. The extruded concrete is supplied at the same time to an entire annular axially extending section. A new inner lining can be inserted and the process repeated to line the tunnel.

As described in German Pat. No. DE-PS 34 06 980 concrete is pumped behind a tunnel excavator through a single upper opening in a forwardly sliding form front.

In order to reliably support the surrounding ground behind the tunnel excavator in loose earth, a steady pressure of flowing concrete behind the form front must be guaranteed which is higher than the ground pressure bearing on the tunnel liner and the pressure or load of the ground water. In order to guarantee that this pressure is continuous, a variety of precautions must be taken for the proper support of the form front and feeding of the concrete.

Although by a resilient support of and a controlled forward motion of the form front there are attained the individual prerequisites for a satisfactory extrusion process a completely unobjectionable concrete extrusion process has yet to be attained.

In practice the concrete pumped through the form front is not deposited layerwise parallel to the forwardly sliding form front as one might expect, but flows in nonpredetermined channels inside the previously pumped in concrete. Thus a clumplike structure results in the continuously forming tunnel liner. At the edge of this clumplike structure the concrete is not thick. It forms a more heterogenous separate zone of so-called nests and holes.

Even disregarding that the strength of this concrete is below normal and even below requisite standards, the inferior quality of the concrete is a source of danger in water bearing loose soil. Water mixed with earth can be forced through holes in the tunnel liner into the tunnel interior. It can endanger the tunnel bed and the stability of the tunnel.

Our research has shown that the flow of concrete into the annular space bounded on the inside by the steel interior form member, on the outside by the surrounding ground, and to the front by the forwardly sliding form front, is a process which is subjected inter alia to the following several factors:

The fluidity of the concrete depends particularly on its specific material properties and on its hardening time, since a chemical reaction is involved.

The surrounding earth influences the fluidity by the roughness of the surface interacting with the concrete and by providing a site through which water lost from the concrete is filtered. As water is lost from the concrete its fluidity is significantly decreased.

The hydrostatic pressure which is generated in the annular space and together with it the position of the concrete input ports in the form front.

The laws of fluid mechanics apply since through the pump opening or concrete input ports in the form front positioned adjacent the upper annular space concrete flows at a reduced pressure into the top of the form in the still softened state which has a reduced shear strength. After extending several meters into the region in which the setting process is in progress and thus the shear strength is increasing, the downward concrete flow is diverted into a region with greater hydrostatic pressure. Through the lower concrete input ports pumped concrete flows through a pressure gradient immediately behind the form front.

The clumps, which are parts or regions of the extruded concrete, act as cohering surfaces behind the forwardly sliding form front and harden there. As a result in this region the fluidity of the concrete is a little less or the pressure potential lines remain constant for a longer time i.e. the pressure gradient may be zero.

The clumps are observed particularly in the region between two concrete input ports in the form front, when the spacing between the concrete input ports is very large. The clumps are therefore a problem, because they circulate under high pressure at the end of the concrete facing the form front and therefore follow the form front. Some of the flow channels behind the clumps collapse or the friction on the ground increases. Then the clumps gather together. At that moment a reduced pressure or a gap arises in the end of the concrete closest to the form front, when the concrete cannot immediately fill up the space between the form front and the remaining clumps as it slides forward.

OBJECTS OF THE INVENTION

It is an object of our invention to provide an improved process for continuously lining a tunnel with concrete which avoids these drawbacks.

It is also an object of our invention to provide an apparatus for continuously making a concrete tunnel lining using the improved method.

It is another object of our invention to provide an improved process for continuously lining a tunnel with concrete, and an apparatus for performing that process, in which clump formation is prevented.

It is another object of our invention to provide an improved process for continuously making a concrete tunnel lining and an apparatus for performing this process, which provide a tunnel lining having an improved homogeneity and strength particularly in water-carrying loose soil.

It is yet another object of our invention to provide an improved process for continuously making a concrete tunnel lining and an apparatus for performing that process, which provides a tunnel lining of improved reliability, consistency and strength.

SUMMARY OF THE INVENTION

These objects and others which will become more readily apparent hereinafter are attained in accordance with out invention in a process for continuously lining a tunnel with extruded or pumpable concrete which comprises feeding the concrete rapidly in batches one after another into the tunnel in a plurality of equal-sized arc segments extending in the longitudinal direction of the tunnel distributed over the tunnel circumference. They are also attained in an apparatus for performing the above process comprising a pumping device for feeding the concrete into the tunnel and a form having an interior form member and a forwardly movable form front having a plurality of concrete input ports distributed uniformly about the circumference of the tunnel. In this apparatus the pumping device is connected to the concrete input ports to feed concrete therein.

Accordingly in the process of our invention a plurality of equal constant amounts (slugs) of extruded concrete are fed in succession one after the other circumferentially about the tunnel circumference in equal-sized segments in a time interval which is small compared to the hardening time of the extruded concrete. Accordingly in the apparatus of our invention the pumping device services each of the concrete input ports circumferentially in succession one after the other.

In other words the extruded concrete should be forced rapidly through several pump openings or concrete input ports spaced not too far from each other uniformly about the circumference of the form front. By supplying the concrete in equal constant quantities through the concrete input ports equally spaced from each other the concrete has the shortest possible flow path as it hardens. Clump formation does not occur.

According to the invention the size of the equal amounts of the extruded concrete is such that the equal-sized segments have a breadth in the longitudinal direction which is smaller than in the circumferential direction or in other words the batch spreads over a predetermined axial and a predetermined angular distance such that the latter is greater than the former.

Advantageously our process is particularly effective when the input concrete is provided in six equal-sized segments distributed over the tunnel circumference.

Similarly in the apparatus according to our invention it is particularly advantageous when the form front is provided with at least six concrete input ports distributed uniformly about the circumference of the tunnel.

Another advantageous feature of our invention includes supporting the front side of the form front, that is the side of the form front facing away from the tunnel lining, resiliently. Also the rear side of the form front facing toward the tunnel lining is provided with an elastic flexible surface. This elastic flexible surface can be formed on a member filled with water. The hollow ring member can be composed of rubber or plastic.

The movement forward of a rigid but resiliently supported form front by the pressure of the concrete, makes a variety of stresses on the circumference of the form front. The concrete is simultaneously forced behind the form front through the concrete input ports into the region to be filled. Since it comprises a rigid steel structure, regions of reduced pressure arise in the form due to its motions at about half the height of the tunnel cross section. This pressure reduction can, in cases where it exceeds a definite level, lead to a total concrete pressure at this position less than the pressure operating on the concrete from the outside from the ground and the water applied load. The consequence could be a displacement of the concrete at this position by the water saturated loose earth.

This danger can be met effectively if the front side of the form front facing away from the tunnel lining in the longitudinal direction is supported resiliently. The increment of the forward motion of the rigid form front should be held as small as possible during each individual filling, and of course only comparatively small quantities are pumped in. The necessarily rapid switchover from concrete input port to concrete input port is important in the process. The concrete is moved during the individual input steps in short time intervals which reduces the danger of hardening. As a second step, alone or together with the step described, we reduce the pressure reduction at about half height of the tunnel cross section, by forming the rear side of the form front facing toward the tunnel liner with a flexible elastic surface. Thus, for example a water filled rubber ring member can be used to compensate for any local stress points.

BRIEF DESCRIPTION OF THE DRAWING

The above and other objects, features and advantages of our invention will become more readily apparent from the following description, reference being made to the highly diagrammatic drawing in which.

SPECIFIC DESCRIPTION

Figure 1:
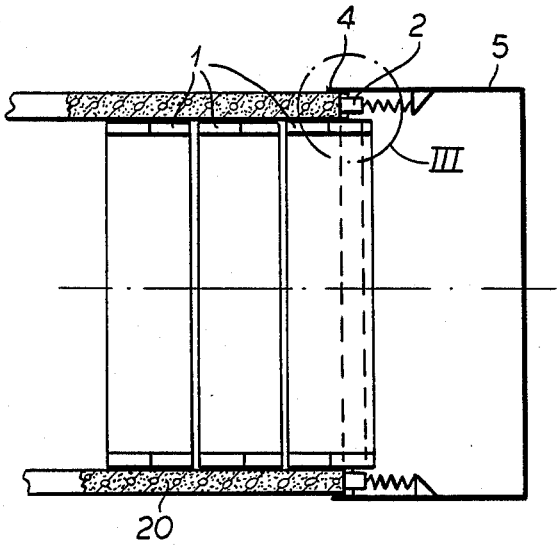
FIG. 1 is a longitudinal cross sectional view of an apparatus for continuously lining a tunnel with extruded concrete according to our invention.

The apparatus shown in the drawing comprises basically a form 1, 2 including an interior form member 1 (in this case cylindrical) and a forwardly movable form front 2 and a pumping device 21 connected to the form front 2 for input of extruded concrete.

Figure 2:
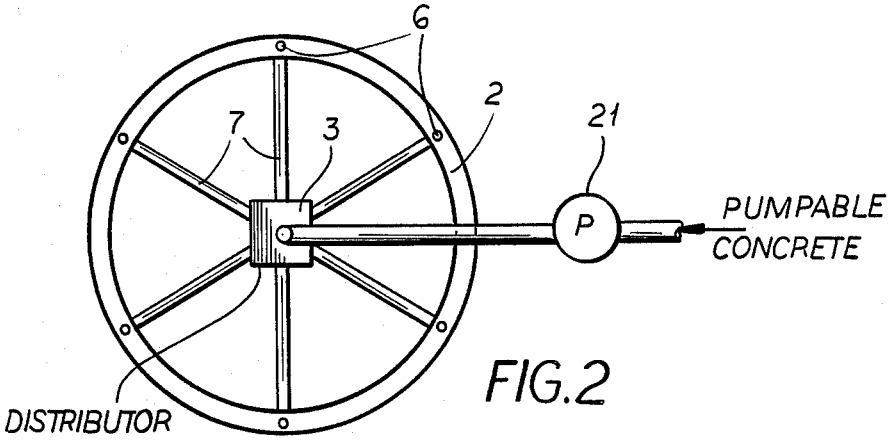
FIG. 2 is a front elevational view of a form front of the apparatus according to FIG. 1.
Figure 3:
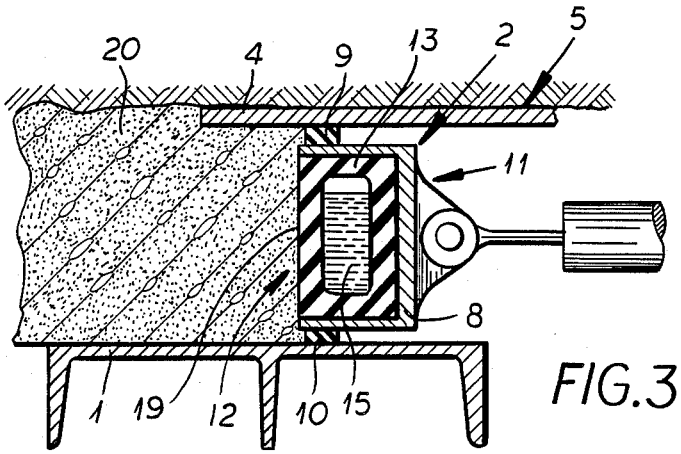
FIG. 3 is an enlarged view of a portion III of FIG. 1 showing in greater detail a part of the apparatus.

The form front 2 is mounted between a shield end 4 of a tunnel excavator shield extension 5 and the interior form member 1 (compare FIGS. 1 and 3). As can be seen from FIG. 2, the form front 2 is provided with altogether six concrete input ports or pump openings 6, which are distributed uniformly about the circumference of the form front 2.

These concrete input ports 6 are connected by concrete conducting members 7 to a distributor 3 connected to pump 21, which is designed to service the concrete input ports 6 in succession one after the other circumferentially and to deliver a fixed volume slug of concrete to each sector served thereby.

The form front 2 comprises a rigid ring 8 having a U-shaped axial cross section contacted by a fitting in the circular elastic seals 9 and 10.

Elastic seal 10 closes the open space between rigid ring 8 and the cylindrical interior form member 1. Form front 2 is supported resiliently at its front end 11 facing away from the tunnel lining 20 in the tunnel longitudinal direction. That is indicated only schematically in FIG. 1. From FIG. 3 one can see that the form front 2 is provided on its rear side 12 facing toward the tunnel liner 20 with an elastic yielding surface 10. This elastic surface 19 is formed as part of a hollow rubber ring member 13 filled with fluid 15, in this case water, which is mounted in the U-shaped cross sectioned rigid ring 8.

The extruded concrete is fed in comparatively small but equal-sized quantities in rapid succession circumferentially into the concrete input ports 6 behind which one finds the above described segments.

We claim:

1. A method of forming a continuous lining in a tunnel having an inner surface, a circumference, and extending along an axis with pumpable concrete having a predetermined hardening time and by means of a form having a stationary annular wall form and an axially, forwardly movable front wall adjacent the inner surface of the tunnel, which movable front wall is resiliently supported against forward displacement, the method comprising the steps of: successively injecting equal-sized batches of pumpable concrete circumferentially about the circumference of the tunnel through a plurality of angularly equispaced ports in the movable front wall, the batches being injected axially backwardly through the ports at such a rate that succeeding batches are injected through each port at a time interval that is substantially smaller than the concrete hardening time and at such a pressure as to forwardly displace the resiliently supported front wall; and forwardly displacing the front wall at such a rate and dimensioning the batches such that each batch spreads at the inner surface of the tunnel in a predetermined axial and a predetermined angular distance such that the latter is greater than the former.

2. A method of forming a continuous lining in a tunnel having an inner surface, a circumference, and extending along an axis with pumpable concrete having a predetermined hardening time and by means of a form having a stationary annular inner wall form and an axially, forwardly movable front wall adjacent the inner surface of the tunnel, which movable front wall is resiliently supported against forward displacement, the method comprising steps of:

successively injecting equal-sized batches of pumpable concrete circumferentially about the circumference of the tunnel through a plurality of angularly equispaced ports in the movable front wall, the batches being injected axially backwardly through the ports at such a rate that succeeding batches are injected through each port at a time interval that is substantially smaller than the concrete hardening time and at such a pressure as to forwardly displace the resiliently supported front wall; and forwardly displacing the front wall at such a rate and dimensioning the batches such that each batch spreads at the inner surface of the tunnel both axially and angularly such that the angular spreading is greater than the axial spreading.

3. A method of forming a continuous lining in a tunnel having an inner surface, a circumference, and extending along an axis with pumpable concrete having a predetermined hardening time and by means of a form having a stationary annular inner wall form and an axially, forwardly movable front wall adjacent the inner surface of the tunnel, which movable front wall is resiliently supported against forward displacement, the method comprising the steps of:

successively injecting equal-sized batches of pumpable concrete circumferentially about the circumference of the tunnel through the form, the batches being injected axially backwardly through a plurality of ports in the form at such a rate that succeeding batches are injected through each port at a time interval that is substantially smaller than the concrete hardening time and at such a pressure as to forwardly displace the resiliently supported front wall; and forwardly displacing the front wall at such a rate and dimensioning the batches such that each batch spreads at the inner surface of the tunnel in a predetermined axial and a predetermined angular distance such that the latter is greater than the former.

* * * * *